United States Patent [19]

Vachhani et al.

[11] Patent Number: 4,662,699

[45] Date of Patent: May 5, 1987

[54] ELECTRICAL CONNECTOR MODULE

[75] Inventors: Vasantrai A. Vachhani; John W. Humphrey, both of Eden Prairie, Minn.

[73] Assignee: Magnetic Controls Co., Minneapolis, Minn.

[21] Appl. No.: 650,252

[22] Filed: Sep. 13, 1984

Related U.S. Application Data

[63] Continuation of Ser. No. 321,107, Nov. 13, 1981, abandoned.

[51] Int. Cl.[4] ..... H01R 4/24

[52] U.S. Cl. ..... 339/97 P; 339/128; 339/198 R

[58] Field of Search ..... 339/17 C, 18 R, 18 B, 339/97 R, 97 P, 98, 99 R, 103, 113 L, 126 R, 126 RS, 128, 198 R, 217 S

[56] References Cited

U.S. PATENT DOCUMENTS

| | | | |
|---|---|---|---|
| 3,065,035 | 11/1962 | Biesecker | 339/128 |
| 3,147,058 | 9/1964 | Zdanis | 339/97 R |
| 3,760,331 | 9/1973 | Gurley | 339/97 P |
| 3,772,635 | 11/1973 | Frey et al. | 339/99 R |
| 3,976,350 | 8/1976 | Keglewitsch | 339/97 P |
| 4,045,111 | 8/1977 | Peterson | 339/97 R |
| 4,163,596 | 8/1979 | Aysta et al. | 339/97 P |
| 4,373,769 | 2/1983 | Mathe et al. | 339/97 R |

FOREIGN PATENT DOCUMENTS

| | | | |
|---|---|---|---|
| 935494 | 2/1948 | France | 339/128 |

*Primary Examiner*—Joseph H. McGlynn

*Attorney, Agent, or Firm*—Merchant, Gould, Smith, Edell, Welter & Schmidt

[57] ABSTRACT

An electrical connector module adapted for use in an access member to provide access to a circuit. The module includes an insulated housing surrounding a connector element and the housing includes a pair of side walls with edges forming a wire gripping slot. The module has particular advantages when arranged in an array to provide access to a plurality of circuits. The invention also relates to an improved connector element usable in connection with the electrical connector module.

5 Claims, 19 Drawing Figures

ELECTRICAL CONNECTOR MODULE

This is a continuation of application Ser. No. 321,107, filed Nov. 13, 1981, now abandoned.

BACKGROUND OF THE INVENTION

The present invention relates generally to an electrical connector module, and more particularly, to an electrical connector module designed primarily for use in the communications or data transmission industries to provide access to and electrically connect one or more of a plurality of electrical circuits or leads to one or more other such circuits or leads.

In the communications industry, and particularly in the telephone industry, it is often necessary to electrically connect a relatively large number of first circuits or leads with a similar number of second circuits or leads. These are commonly referred to as incoming and/or outgoing leads. As a result of growth, relocation or reassignment, changing of telephone numbers, etc., these electrical connections between the incoming leads and the outgoing leads undergoes change on a regular basis. To facilitate this relatively constant change, the prior art provides circuit access members such as connector panels or terminal blocks. These panels and terminal blocks provide for termination of the incoming and outgoing leads at the rear face of the panel or terminal block. This termination is normally accomplished by conventional techniques such as wire wrap, soldering or the like. The front side of such panel or terminal block provides means for electrically accessing each of the individual incoming or outgoing leads via a connector element. In some cases, this access was provided by a wire wrap pin with the connections between such pins being made via a conventional wire wrap or soldering process. These systems, however, were highly inefficient and time consuming because of the relatively frequent changes in connections required as a result of growth, relocation or reassignment, changes in telephone numbers, etc.

In an effort to overcome the inefficiencies of using a wire wrap process, leads in many of the access members were accessed via a receptacle. A plurality of patch cords of fixed length with patch plugs engageable with the receptacles were then used to access the particular circuits or leads and electrically connect the same with a second circuit or lead. With these patch cords, an incoming lead could be patched or electrically connected to a remotely located outgoing circuit much more efficiently than using a wire wrap or soldering process. In some cases, however, the connectors associated with the circuits desired to be connected were only a few inches apart, while in other cases they were several feet or more apart, thus requiring a substantially longer patch cord. As a result of these differing conditions, a relatively large inventory of different lengths of patch cord had to be kept available in order to accommodate the various distances between the connectors desired to be connected.

Because of these disadvantages, connectors were developed which eliminated the need for patch cords of fixed lengths. These connectors provided means for directly connecting one end of a jumper or connecting wire to a first connector element and means for directly connecting the opposite end of the jumper or connecting wire to a second connector. A tool was also provided for use with these connectors to connect the jumper wire to the connector elements and to sever excess wire after the connection had been made. With these connectors, a single spool of wire could be used to make the various connections desired, thus eliminating the need for maintaining an inventory of patch cords. Two such connectors used for this purpose are identified in U.S. Pat. Nos. 3,518,618 and 4,283,105. Although these connectors were satisfactory in many respects, they inherently embodied several limitations. First, because of their particular configuration and operation, the density of an array of such connectors was limited. Secondly, unlike the connectors utilizing patch plugs and patch cords, the above-described connectors were not insulated. Thus, inadvertent shorting or interference with connected circuits was common as a result of manually brushing across another connector or inadvertently causing a conductive material to come in contact with another connector element. This was and continues to be a particularly serious problem in data transmission circuits where such a short can result in the loss of data. Thirdly, many of the prior art connectors did not provide for the connection of multiple wires to an individual connector without using two patch plugs stacked together. Thus, if it was desired that a particular first lead or circuit be connected to more than one second lead or circuit, a commoning bar or other similar means was necessary. Fourthly, neither of the above connectors provided strain relief means for reducing the possibility of jumper wires being inadvertently pulled from the connectors.

Accordingly, there has been a need in the art for an improved electrical connector module usable in the communications or data transmissions industries which eliminates the disadvantages of having to maintain an inventory of several different lengths of patch cords and which also eliminates the various other limitations of known connectors of the type described above.

SUMMARY OF THE INVENTION

The present invention relates to an improved electrical connector module of the type which is adapted for use in the communications or data transmission industries to connect a plurality of first circuits or leads with a plurality of second circuits or leads. Specifically, the present invention is adapted for use in a connector panel or terminal block to cross-connect various telephone circuits or leads. In contrast to the prior art, the improved connector module of the present invention includes a structure which allows for the density of an array of such modules to be increased over other possible arrangements of prior art connectors in an array layout. Additionally the improved module of the present invention utilizes a split cylinder connector and an insulated housing to electrically insulate various connector elements from one another and to substantially eliminate inadvertent shorting of circuits. Further, the improved connector of the present invention is capable of accepting a multiplicity of wires, thus eliminating the need for adjacent connector elements to be electrically connected by a commoning bar or for the use of stacked patch plugs. Still further, the improved module of the present invention facilitates color coding to assist in identification of various incoming and outgoing leads, and includes strain relief means for the jumper wires.

More specifically the preferred embodiment of the improved module of the present invention includes a double ended split cylinder connector. One end of this connector is disposed on the backside of a quick connect panel or terminal block for termination of various incoming or outgoing circuits. The other end is disposed on the front face of the connector panel or terminal block to provide access for cross connection of such circuits. Although some of the functional features of the split cylinder connector are conventional in the art, several novel features exist. One of these features includes an improved means for retaining and securely supporting the double ended split cylinder connector within the panel or terminal block to adequately resist wire insertion forces from both ends. A further novelty relates to an improved wire cut-off feature.

The above-mentioned double ended split cylinder connector is mounted in an elongated insulated housing which is in turn securely mounted within an opening in the connector panel or terminal block. This housing includes a central section with a centrally located cylindrical opening to accept and retain the double ended connector. The portion of the housing on the front side of the panel or terminal block is provided with a plurality of side walls which are spaced from the outer cylindrical surface of the split cylinder connector. A pair of diametrically opposed, elongated slots are provided at the corners of the housing by the edges to facilitate the connection of a jumper or connecting wire with the split cylinder connector. These slots are provided on the diagonal of the generally square shaped upper portion of the housing to provide improved strain relief means. The diagonally disposed slots also facilitate an increase in the density of an array of the connectors by enabling the same to be positioned in side-by-side relationship to one another. Although the connector module of the present invention can be used individually, the advantages of such module are best realized when a plurality are combined in an array. As will be seen in the description below, the connector modules of the present invention also facilitate color coding to assist in identifying certain leads and distinguishing those leads from others.

Accordingly, a primary object of the present invention is to provide an improved electrical connector module usable in a connector panel or terminal block of the type used in the communications or data transmissions industries to connect various first leads with selected second leads.

Another object of the present invention is to provide an improved electrical connector module capable of being arranged in an array to increase the density of such modules.

A further object of the present invention is to provide an improved electrical connector module which includes an insulated housing and which is capable of substantially eliminating inadvertent shorting of the leads.

A still further object of the present invention is to provide an improved electrical connector embodying a double ended split cylinder connector with improved means for retaining the same within an insulated housing.

A still further object of the present invention is to provide an electrical connector module usable in a connector array and enabling color coding to assist in the identification of certain electrical leads.

Another object of the present invention is to provide an improved electrical connector module with an insulated housing having an improved strain relief means.

These and other objects of the present invention will become apparent with reference to the drawings, the description of the preferred embodiment and the appended claims.

DESCRIPTION OF THE PREFERRED EMBODIMENT

Figure 1:
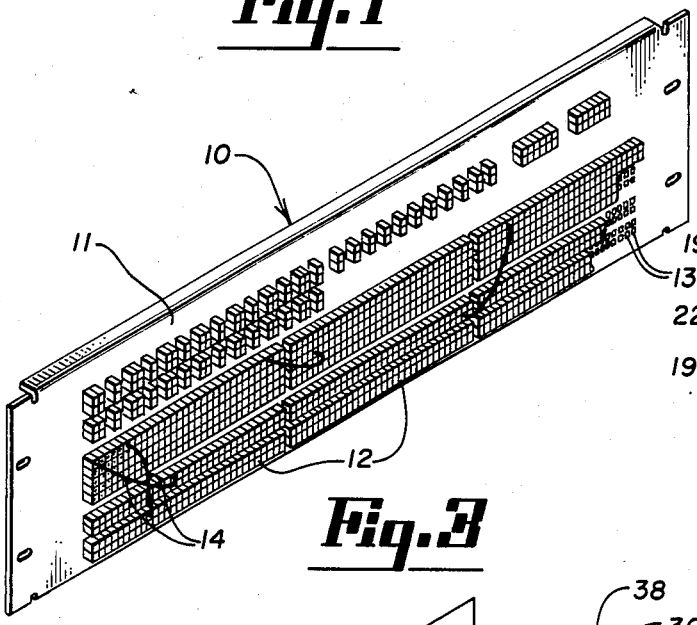
FIG. 1 is a pictorial view showing a connector panel with an array of the improved electrical connector modules of the present invention inserted therein.

The electrical connector module of the present invention is adapted for use in an access member such as a quick cross connect panel or in a terminal block to electrically connect various electrical leads or circuits with certain other electrical leads or circuits. In the preferred embodiment, certain of these leads may be referred to as incoming leads while others are often referred to as outgoing leads. In actual practice, these incoming and outgoing leads may represent communication circuits such as telephone lines or various types of data transmission circuits. Where the leads are telephone lines, the electrical connector module of the present invention is utilized to patch or cross connect such lines to accommodate growth of telephone usage, changes in telephone number, relocation of users, etc. Reference numeral 10 in FIG. 1 represents a quick cross connect panel adapted for use as described above. This panel 10 includes a relatively flat panel member 11 and a plurality of electrical connector modules 12. As illustrated in FIG. 1, the modules 12 are arranged in side-by-side adjacent relationship with respect to one another in an array. As will be described in greater detail below, the modules 12 may be color coded to identify various types of incoming or outgoing leads or circuits to distinguish those from others. Each of the individual electrical connector modules 12 is inserted into and retained within a hole or opening 13 in the panel member 11. In FIG. 1 a portion of the modules 12 have been removed from the panel 11 to show these holes 13.

Figure 2:
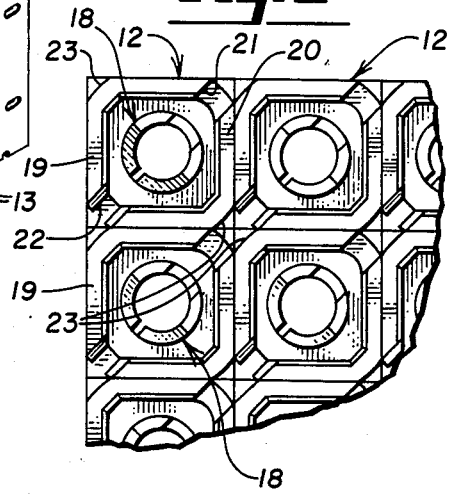
FIG. 2 is a top elevational view of a portion of an array of the electrical connector modules of the present invention.

Reference is next made to FIGS. 2, 3, 4 and 5 showing the specific details of the electrical connector module of the present invention. As illustrated specifically in FIG. 2, each of the modules 12 is intended for positioning in side-by-side relationship with respect to another. Each module 12 includes a housing 16 constructed of a non-conductive material and a centrally positioned split cylinder connector member 18. As illustrated best in FIG. 3, the housing 16 includes a central portion 25, a pair of upwardly extending side wall portions 19 and 20 and a pair of downwardly extending side wall retaining sections 26 and 27. The centrally positioned portion 25 is defined by four flat side wall surfaces extending at right angles with respect to the plane of the panel member 11. In the preferred embodiment, the dimensions of each side wall of the central portion 25 is the same, thus giving the portion 25 a square cross sectional configuration. When the module 12 is disposed in an array as illustrated in FIGS. 1 and 2, the side walls of the central portion 25 are closely adjacent to a corresponding side wall of an adjacent module and a lower surface of the portion 25 engages the top surface of the panel 11. The portion 25 includes a cylindrical opening 31 (FIG. 6) to facilitate insertion of the connector 18.

Each of the upwardly extending side wall portions 19 and 20 is integrally formed with the central section 25 and each includes a pair of integrally joined side wall sections disposed at right angles with respect to each other. Each of these side wall sections extends upwardly in the same plane as a corresponding side wall of the central portion 25. As illustrated, a portion of the corner 23 joining adjacent side wall sections of the side wall sections 19 and 20 is cut away, so that its outer edge is spaced inwardly from the outer corner of the central section 25. As shown in FIG. 2, these cut away corners 23 are recessed to provide an opening at the corners between diagonally adjacent modules 12 (FIG. 2). This opening provides exit space for jumper or connecting wires 14 (FIG. 1) which extend through the wire gripping slott 22.

Adjacent edges of the side wall sections 19 and 20 are spaced from each other to define a pair of slots or grooves 21 and 22. The slot 21 is normally wider than the slot 22 and has a width which is at least as wide as the outer diameter of the insulated connector wire 14 (FIGS. 1 and 12) used to make the electrical connection between desired leads. The slot 22 has a width which is less than the exterior diameter of the jumper wire and functions as a strain relief wire gripping slot to grip such wire and prevent the same from being inadvertently pulled from the connector 18. The slot 22 includes an enlarged portion 24 at the top whose width approximates the outside diameter of the jumper wire. This enlarged portion assists in guiding the jumper wire into and aligning the same with respect to the strain relief slot 22. The slot 22 is formed in the diagonal of the housing 16. This provides several advantages. First, it enables a plurality of modules 12 to be arranged in an array. Secondly, because the respective edges of the slot are greater on the diagonal, the wire gripping surface force of the slot 22 is greater. Thirdly, positioning the slot 22 on the diagonal permits a larger range of jumper wires because of the longer side wall portions adjacent to the slot 22.

Figure 4:
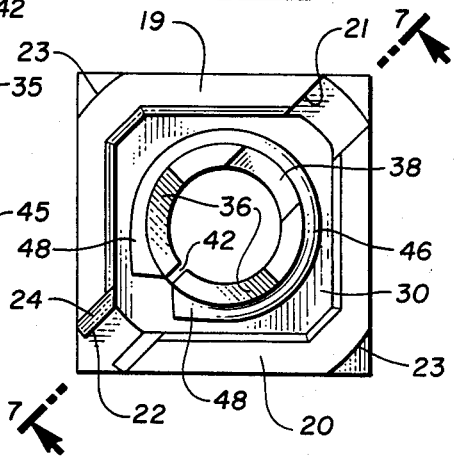
FIG. 4 is a top elevational view of one of the electrical connector modules of the present invention.
Figure 7:
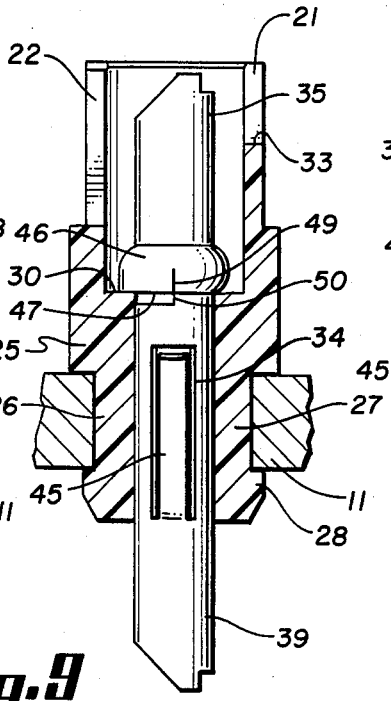
FIG. 7 is a view, partially in section, of the improved electrical connector module of the present invention as viewed along the section line 7—7 of FIG. 4.

As illustrated in FIG. 7 which is a sectional view along the section line 7—7 of FIG. 4, the depth of the slot 21 is less than the slot 22. For example, the wire gripping slot 22 extends downwardly to the top portion of the central section 25, while the wire exit slot 21 which is wider than the insulated jumper wire stops short of the section 25 and extends downwardly only to the shoulder portion 33. During the wire insertion procedure, this shoulder portion 33 causes the free, cut off end of the jumper wire to be bent upwardly as the wire is forced into the module, thereby facilitating easy removal of that portion of the wire which is severed.

Each of the retaining sections 26 and 27 of the housing 16 include a pair of side wall portions which are integrally joined and disposed at right angles with respect to each other. The side wall portions of the retaining sections 26 and 27 are generally parallel to the side walls of the central section 25, are spaced inwardly therefrom and extend downwardly from the section 25 in a direction opposite that of the side walls 19 and 20. As shown in FIGS. 6 and 7, the side walls of the sections 26 and 27 and the side walls of the central section 25 are joined by a shoulder 43 extending at right angles with respect to the side walls of the sections 25, 26 and 27. The retaining sections 26 and 27 are spaced from each other by the slots 29, 29 (FIGS. 3 and 5) to permit the sections 26 and 27 to be moved inwardly toward each other during insertion of the housing 16 into the panel 11. Each of the retaining sections 26 and 27 includes a retaining rib or edge 28 extending outwardly about its lower periphery for engagement with a portion of the panel 11 to prevent the housing 16 from being removed from the panel 11 after it has been inserted.

Figure 5:
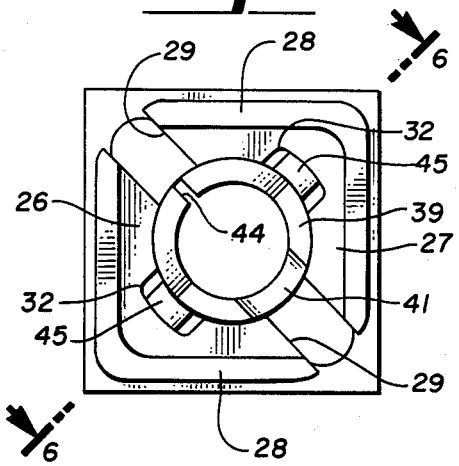
FIG. 5 is a bottom elevational view of one of the electrical connector modules of the present invention.
Figure 6:
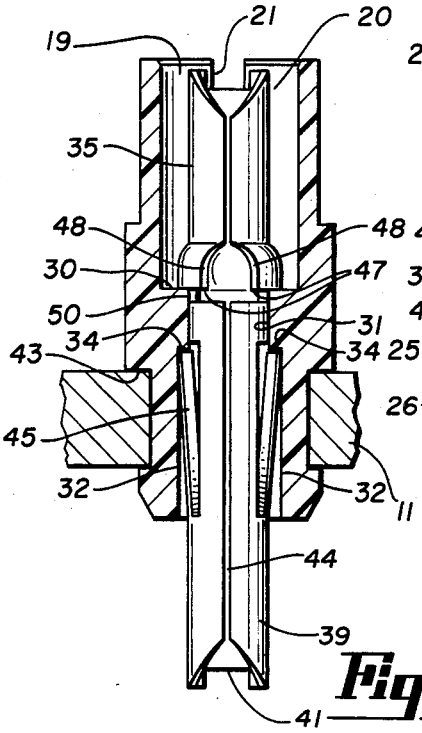
FIG. 6 is a view, partially in section, of the improved electrical connector module of the present invention as viewed along the section line 6—6 of FIG. 5.
Figure 11:
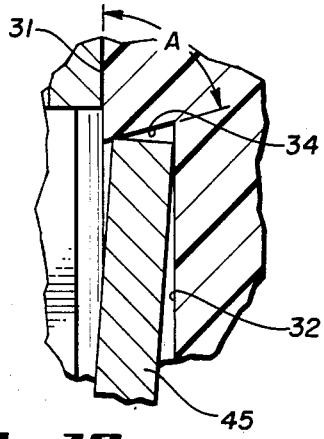
FIG. 11 is a view, partially in section, showing the retaining relationship between the retaining tine of the split cylinder connector and the insulated housing.

As shown in FIGS. 5, 6 and 11, each of the retaining sections 26 and 27 includes an elongated groove 32 to assist in retaining the split cylinder connector 18 within the housing 16. Each of the grooves 32 includes a shoulder portion 34 adapted for engagement by a retaining tine 45 extending outwardly from the connector 18. As shown best in FIG. 11, this shoulder portion 34 is beveled at a negative angle to insure engagement between the end of the tine 45 and the shoulder 34 to prevent inadvertent removal of the connector 18 from the housing 16. In the preferred embodiment, the included angle "A" formed between the beveled shoulder 34 and the interior surface 31 is less than 90 degrees. As illustrated best in FIGS. 5 and 7, the internal surface of the retaining members 26 and 27 have a generally cylindrical configuration extending from the surface 31 of the section 25 to permit a relatively tight fit between such surface and the outer cylindrical surface of the split cylinder connector 18. When the housing 16 and the cylinder 18 are inserted within the panel 11, this tight fitting relationship keeps the retaining ribs 28, 28 engaged with the bottom surface of the panel 11 and precludes inadvertent removal of the module 12 from the panel 11.

The split cylinder connector 18, which is best illustrated with reference to FIGS. 2–8, includes a generally cylindrical upper portion 35, a generally cylindrical lower portion 39 and an enlarged collar section 46. The upper cylindrical section 35 includes an elongated slot 42 for piercing the insulation of an insulated wire 14 and for gripping and making electrical contact with such wire. A pair of guide sections 36, 36 are integrally formed with the slot 42 and are positioned at the top end of the cylindrical section 35. A cutting edge 38 is also disposed near the top edge of the upper cylinder 35 and opposite the slot 42. As will be described in greater detail during a discussion of the operation of the module 12, the edge 38 functions to sever the wire 14 during insertion into the upper cylindrical portion 35. In the preferred embodiment, the edge 38 is disposed above the intersection between the sections 36, 36 and the slot 42 to permit the wire 14 to be severed prior to insertion into the slot 42.

Figure 3:
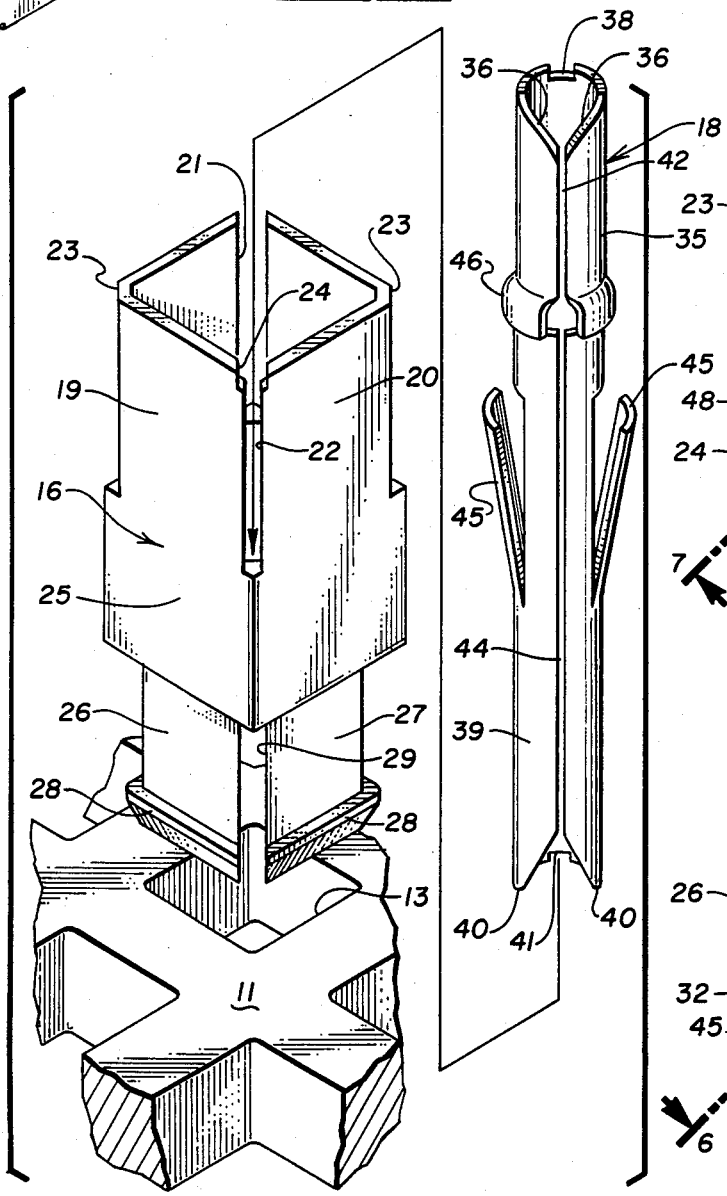
FIG. 3 is a pictorial view showing the double ended split cylinder connector, the insulated housing and a portion of the panel member.
Figure 8:
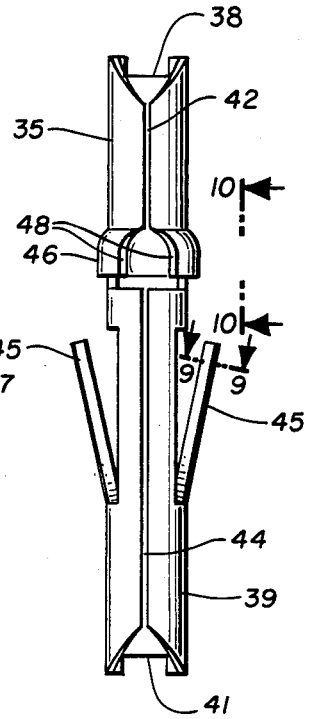
FIG. 8 is a front elevational view of the double ended split cylinder connector used in the electrical connector module of the present invention.

The lower cylindrical section 39 also includes an elongated slot 44 for piercing the insulation of the jumper wire and for gripping and making electrical contact with such wire. A pair of entrance or guide edges 40, 40 are positioned at the bottom edge of the cylinder 39 and are integrally formed with the opposing edges of the slot 44. As shown in FIGS. 3, 6 and 8, a cutting edge 41 similar to the edge 38 is also formed in the bottom surface of the cylindrical member 39.

Figure 9:
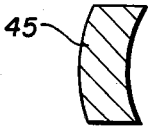
FIG. 9 is a cross sectional view of one of the retaining tines as viewed along the section line 9—9 of FIG. 8.

A pair of flared retention tines 45, 45 are cut from opposing side portions of the cylindrical portion 39 and are prestressed so that they are disposed outwardly from the outer cylindrical surface of the section 39 as illustrated in FIGS. 3 and 8. As shown best in FIGS. 3 and 9, each of the tines 45, 45 is curved or coined so as to substantially conform to the curved inner surface of the grooves 32 (FIG. 5). This increases the surface area engageable with the shoulder 34 (FIG. 11) and improves the retaining ability of the tines 45, 45.

Figure 10:
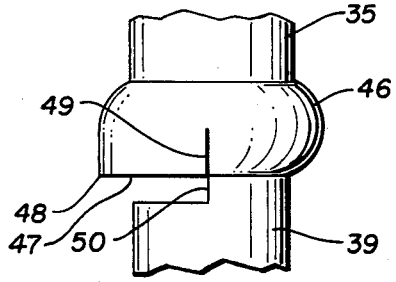
FIG. 10 is an elevational side view of a portion of the split cylinder connector as viewed along the line 10—10 of FIG. 8.

The split cylinder connector 18 also includes an enlarged peripheral rib or collar section 46 adapted for engagement with the seating surface 30 (FIGS. 4, 6 and 7) of the central section 25 when the connector 18 is inserted therein. As shown best in FIGS. 3, 4, 6, 7 and 8, a partial cross slit 50 is made in the connector 18 immediately below the collar 46. The collar 46 is then split and the corners flared out as illustrated by the reference numerals 48, 48 in FIGS. 4, 6, 7 and 8. In the preferred embodiment, the collar 46 is split in the same general location as the slot 42. To facilitate the flaring of the edges 48, 48, a vertical cut 49 (FIGS. 7 and 10) is also made on opposite sides of the collar 46. With the above structure, a significantly increased bearing area is provided for engagement with the seating section 30. The flared out portions 48, 48 provide a corresponding bottom seating surface 47 for engagement with this supporting surface 30. It has been found that this particular arrangement provides a substantially improved support and stability for the connector 18 when retained within the housing 16. As seen best in FIG. 6, the distance between the bottom seating surface 47, 47 and the top ends of the ribs 45, 45 should be approximately the same distance as between the seating surface 30 and the beveled shoulder portions 34, 34.

Figure 13:
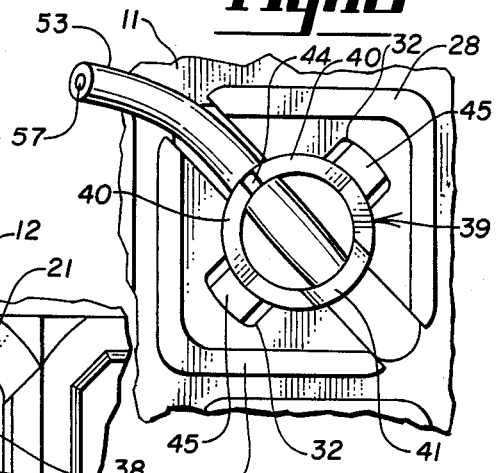
FIG. 13 is an elevational view of the back side of the connector panel showing a wire connected with the bottom end of the split cylinder connector.
Figure 12:
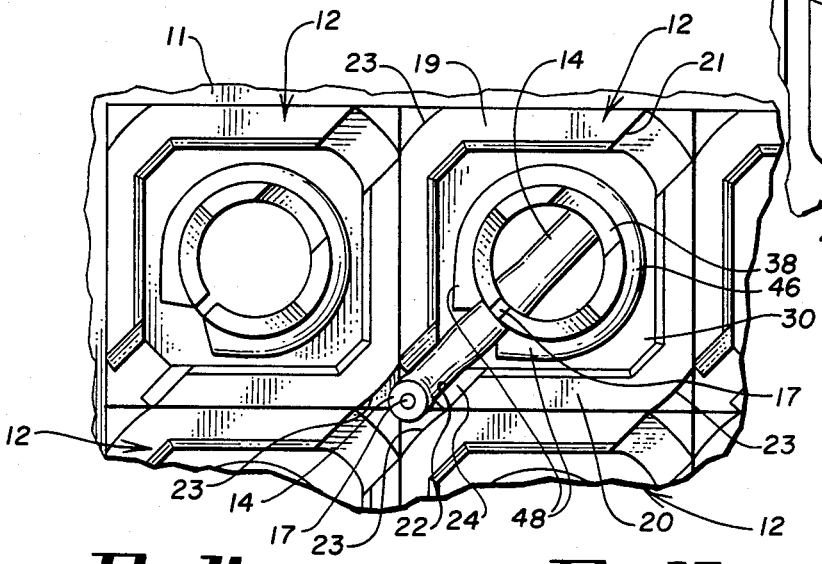
FIG. 12 is a top elevational view similar to that of FIG. 2 showing an array of the electrical connector modules of the present invention with a jumper or connecting wire inserted therein.

FIG. 12 shows a plurality of adjacent modules 12 illustrating the manner in which a jumper wire 14 is inserted and retained within one of the modules, while FIG. 13 shows a wire 53 inserted and retained within the connector portion 39 on the back side of the panel 11. In both cases, the wire is inserted with a tool similar to that illustrated in FIGS. 17, 18 and 19. Such tool includes a handle 60, an elongated intermediate section 61 and an end section shown in FIGS. 18 and 19. The end section includes an open portion 68 defined by the peripheral side wall 62 and the centrally positioned post 66. Each of the corners 65 of the side wall 62 is angled to fit within the interior of the housing 16 (FIG. 3). A pair of diametrically opposed recessed portions 64, 64 are provided at two of the corners 65 to receive the wire 14 during the insertion process.

To insert the insulated wire 14 on the front side of the panel as shown in FIG. 12, a section of the wire is laid across the top surface of the module 12 such that a portion of the wire contacts both the cut-off edge 38 and the guide edges 36, 36 in the area of the slot 42. The enlarged portion 24 and the slot 21 assists in this alignment. It should be noted that the portion of the wire 14 to be severed is that portion engaging the cutting edge 38 while the portion making electrical contact with the connector 18 is that portion engaging the edges 36, 36. The tool is then appropriately positioned over the wire 14 with the recessed portions 64, 64 (FIG. 19) aligned with the wire and the side wall 62 disposed between the inner surface of the housing side walls 19 and 20 and the outer surface of the cylindrical portion 39 of the connector 18. A downward force then causes the wire 14 to be inserted into the module 12 to the position illustrated in FIG. 12. During the application of such force, the wire 14 is cut by the cutting edge 38 while the portion of the wire engaging the guide surfaces 36, 36 is forced between the contact slot 42. During downward movement of the wire 14, the edges of the slot 42 pierce the insulation of the wire and make electrical contact with the conductor portion 17. The tool also causes a portion of the wire to be forced between the wire gripping or strain relief slot 22, thus causing the operative end of the wire 14 to be retained by the slot 22 in the manner illustrated in FIG. 12. This end of the wire 14 then extends upwardly in the area between diagonally adjacent modules 12 formed by the recessed edges 23, 23 for connection to a second module. The cut off end of the wire is also forced downwardly by the tool; however, because of the shoulder portion 33 (FIG. 7), the cut off end of the wire is forced upwardly. This facilitates easy manual removal of the wire end which has been severed.

FIG. 13 shows a wire 53 connected with the back side of the panel member 11. This wire 53 is connected in a manner similar to the connection on the front side of the panel by using the tool illustrated in FIGS. 17–19. First, the wire is laid across the connector cylinder 39 so that portions of the wire 53 engage the edge 41 and the edges 40, 40 in the area of the slot 44. The tool is then appropriately aligned and an insertion force is exerted. The force severs the portion of the wire engaging the edge 41 and cause the edges of the slot 44 to pierce the insulation of the wire 53 and contact the conductive portion 57.

Figure 14:
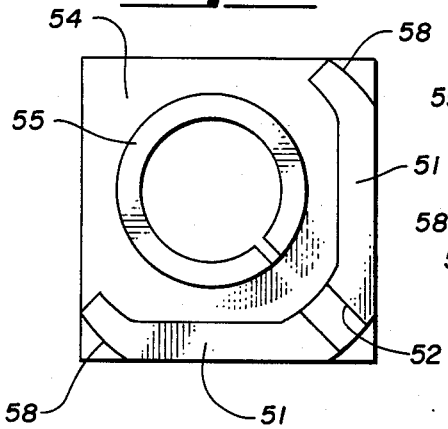
FIG. 14 is a top elevational view of an alternate embodiment of the electrical connector module of the present invention.
Figure 15:
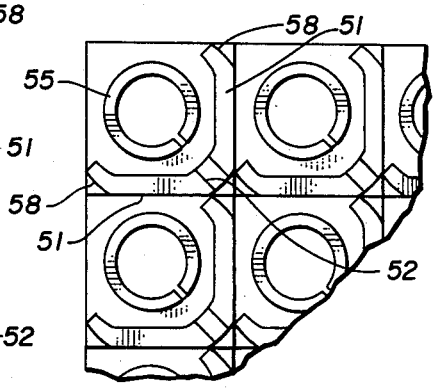
FIG. 15 is a top elevational view of an array of the electrical connector modules of FIG. 14.

FIGS. 14 and 15 illustrate an alternate embodiment of the electrical connector module of the present invention. Specifically, FIG. 14 illustrates an alternate embodiment of a single module, while FIG. 15 illustrates an array of a plurality of such modules. The structure of FIGS. 14 and 15 include a pair of insulated side walls 51, 51 which are separated at their adjacent corner by a wire gripping slot 52. Similar to the preferred embodiment described above, the slot 52 is positioned on the diagonal of a module having a square cross sectional configuration. The opposite ends of each of the side walls 51, 51 includes a recessed surface 58, 58 to allow for the modules to be positioned in an array as illustrated in FIG. 15. These recessed corners provide sufficient room for the jumper wire to loop upwardly after insertion into the wire gripping slot 52. The alternate embodiment of the module illustrated in FIGS. 14 and 15 also includes a split cylinder connector 55. In this alternate embodiment, however, the diameter of the element 55 can be larger than the connector 18 shown in FIG. 3 because of the absence of the second side wall sections of the side walls 51, 51. In the embodiment of FIGS. 14 and 15, the center of the connector cylinder 55 is off-set toward the corner of the module opposite the slot 52. Thus, with the alternate embodiment of FIGS. 13 and 14, a larger connector 55 can be used without decreasing the density of the connectors for a given area.

Figure 16:
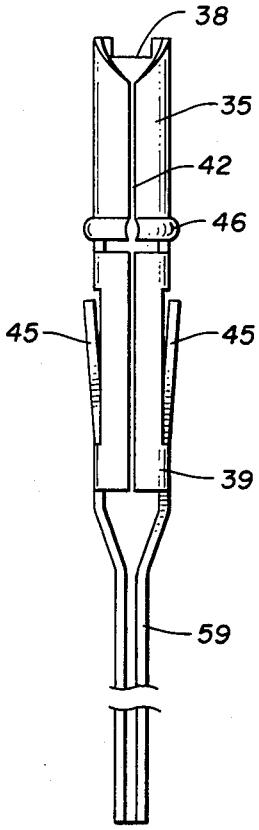
FIG. 16 is an alternate embodiment of the split cylinder connector usable in the electrical connector module of the present invention.

FIG. 16 illustrates an alternate embodiment of a split cylinder connector. The connector 18 (FIG. 3) of the preferred embodiment includes a double ended connector having a split cylinder type of connecting means at both ends. In the alternate embodiment of FIG. 16, however, the lower end of the connector includes an elongated portion 59 adapted for connection with a lead via conventional wire wrapping. It is contemplated that this alternate embodiment of FIG. 16 could be utilized with the improved module housing described above.

Having described the structure of the preferred and alternate embodiments, the assembly of the module of the present invention can be described as follows. To assemble a panel 10 of the type illustrated in FIG. 1, a plurality of the insulated housing elements are first inserted in the holes 13 in the panel member 11. As pointed out previously, one of the advantages of the electrical connector module of the present invention is that it is capable of assisting in the identification of particular incoming or outgoing leads by color coding. Thus, these housings can be color coded and arranged for insertion into the panel to facilitate such identification. The individual housings in an array can also be oriented so that the jumper wires from the modules will all extend in a particular direction. For example, if modules in one array are to be connected with modules in a second array, the modules may be oriented such that the jumper wires, when inserted, extend in a general direction toward the other array.

Figure 17:
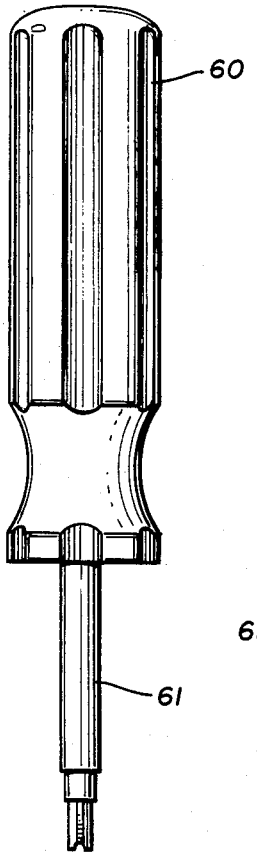
FIG. 17 is an elevational view of the tool used to insert an insulated wire into the split cylinder connector to terminate the same.
Figure 18:
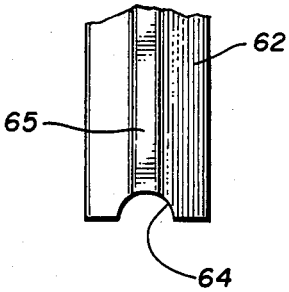
FIG. 18 is an enlarged side view of the operative end of the insertion tool.
Figure 19:
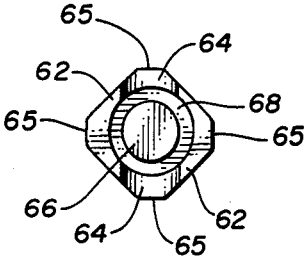
FIG. 19 is an enlarged end view of the operative end of the insertion tool.

The insertion can be done either with the tool illustrated in FIGS. 17–19 or any other similar tool with an elongated end to fit within the housing side walls. The lower portion of the housing, specifically the retaining sections 26 and 27, are forced into the hole 13 in the panel 11 until the retaining edges 28, 28 snap outwardly into engagement with the lower surface of the panel 11 as illustrated in FIGS. 6 and 7. The split cylinder connector 18 is then inserted into the cylindrical opening 31 within the housing 16. This insertion can also be accomplished with the tool of FIGS. 17–19 or other appropriate means. The connector 18 is forced into the central opening of the housing 16 until the retaining tines 45 snap outwardly into engagement with the retaining grooves 32, 32 and the retaining shoulder portions 34, 34 as illustrated in FIGS. 6 and 11. The module is then totally installed. After all of the modules 12 have been inserted within the panel 11, the panel is ready for operation. As described above, a plurality or set of wires or leads 53 representing a plurality of circuits are first connected to the ends of the connector 18 positioned on the backside of the panel 11 (FIG. 1). After these connections have been made, the ends of the connectors on the top side or front face of the connector panel 11 can be connected. This includes connecting insulated jumper wires 14 from one connector to another, thereby connecting the respective leads associated with those connectors. It should be noted that several wires can be connected to each of the connector elements on the top side of the panel, thus facilitating the connection of one lead to a plurality of other leads.

While the description of the preferred embodiment has been quite specific, it is contemplated that various changes and modifications could be made without deviating from the spirit of the present invention. Accordingly, it is intended that the scope of the invention be dictated by the appended claims rather than by the description of the preferred embodiment.

We claim:

1. An electrical connector module for connection with a mounting panel for providing electrical access to a circuit, said electrical connector module comprising:

a housing constructed of an electrically nonconductive material, said housing having pairs of opposed sidewalls forming a generally square cross-sectional shape, with a wire holding slot formed at one corner of the square to receive an insulated wire, said slot having an end and running generally longitudinally of said housing, the housing also having two flexible retaining extensions which fit into a mounting panel aperture, said housing being hollow to accept a connector element;

a tubular cylindrical connector element having a first portion for electrical connection with said circuit and a second portion including an insulation displacement slot substantially aligned with the housing slot for electrical connection with the insulated wire, said first and second portions being electrically connected; and a cooperating cylindrical shoulder and at least two outward projections on the connector element which cooperate so that when the connector element is inserted into the housing, the housing and connector element are fixed to the mounting panel between the shoulder and flexible projections and when the insulated wire is connected to the module, the insulated wire is gripped in said slot of said housing and is received in the insulation displacement slot.

2. The module of claim 1, wherein said housing includes a wire exit slot diagonally opposite the wire holding slot at a corner of the square cross-section, said wire holding slot is configured to grip an insulated wire inserted therein, and said wire exit slot is configured to allow an insulated wire free clearance when the wire passes therethrough.

3. An electrical connector module for connection with a mounting panel for providing electrical access to a circuit, said electrical connector module comprising:

a housing constructed of an electrically nonconductive material, said housing having pairs of opposed sidewalls forming a generally square cross-sectional shape, with slots formed at opposite corners of the square to receive an insulated wire, said slots having ends running generally longitudinally of said housing, the housing also having two flexible retaining extensions which fit into a mounting panel aperture, one of said slots sized to grip an insulated wire and the other of said slots sized to permit clearance thereof;

said housing being hollow to accept a connector element;

a tubular cylindrical connector element having a first portion for electrical connection with said circuit and a second portion including an insulation displacement slot substantially aligned with the housing slot for electrical connection with the insulated wire, said first and second portions being electrically connected;

retaining means on said connector element which cooperate with said retaining extensions to that when the connector element is inserted in the housing, the housing and connector element are fixed to the mounting panel between the retaining means and the flexible projections, and when the insulated wire is connected to the module, the insulated wire is gripped in said slot of said housing and is received in the insulation displacement slot.

4. The module of claim 2 or 3 wherein said connector element includes a cutoff blade substantially aligned with said wire exit slot.

5. The module of claim 4, wherein said wire holding slot is longer than said wire exit slot to facilitate wire connection and removal of unwanted wire length.

* * * * *